US006250359B1

(12) United States Patent
Lorio et al.

(10) Patent No.: US 6,250,359 B1
(45) Date of Patent: Jun. 26, 2001

(54) BEADED CHAIN FOR BLINDS

(76) Inventors: Eric W. Lorio, 449 Borden Cir., San Marcos, CA (US) 92069; Glenn A. Martin, 32 Rollingview La., Fallbrook, CA (US) 92028

( * ) Notice: Subject to any disclaimer, the term of this patent is extended or adjusted under 35 U.S.C. 154(b) by 0 days.

(21) Appl. No.: 09/588,076

(22) Filed: Jun. 6, 2000

(51) Int. Cl.[7] ..... E06B 9/38
(52) U.S. Cl. ..... 160/178.1 V; 160/321
(58) Field of Search ..... 160/178.1 R, 178.1 V, 160/319, 320, 321, 331, 405, 173 V, 177 V, 345, 332; 474/203; 59/78, 2, 80, 81

(56) References Cited

U.S. PATENT DOCUMENTS

| | | | | |
|---|---|---|---|---|
| 822,431 | * | 6/1906 | Crawford | 160/332 |
| 946,779 | | 1/1910 | Hubbell . | |
| 1,051,384 | | 1/1913 | Bradley . | |
| 1,057,491 | | 1/1913 | Morrison . | |
| 1,270,143 | | 1/1918 | Gagnon . | |
| 1,414,821 | | 5/1922 | Kuehner . | |
| 2,714,269 | * | 8/1955 | Charles | 59/78 X |
| 2,884,054 | * | 4/1959 | Bryant | 160/332 |
| 3,977,458 | | 8/1976 | Kuen . | |
| 4,386,644 | | 6/1983 | Debs . | |
| 4,884,618 | * | 12/1989 | Steeves | 160/321 |
| 4,932,456 | | 6/1990 | Buxbaum . | |
| 5,137,073 | | 8/1992 | Huang . | |
| 5,163,492 | * | 11/1992 | Remington et al. | 160/321 X |
| 5,375,643 | | 12/1994 | Rude . | |
| 5,845,696 | * | 12/1998 | Chou | 160/178.1 V |

FOREIGN PATENT DOCUMENTS

| | | |
|---|---|---|
| 10603 | 11/1914 | (GB) . |
| 490470 | 8/1937 | (GB) . |

* cited by examiner

*Primary Examiner*—David M. Purol
(74) *Attorney, Agent, or Firm*—Brown Martin Haller & McClain

(57) ABSTRACT

A differentiated beaded chain is provided as an aid for rotating blind slats in a desired rotational direction. The differentiation is realized utilizing beads of differing sizes or textures along a first and second length of the beaded chain. An operator consistently achieves a desired rotational response by pulling one of the first and second lengths. The differentiated beads are identifiable by either touch or sight. Similarly, a differentiated cord is provided for opening and closing blinds or curtains along a vertical or horizontal plane. The cord consists mainly of a first texture and utilizes a second texture along a portion of a length of the cord to provide an operator with a means for identifying an expected result of tugging on either of the first or second textured lengths.

21 Claims, 2 Drawing Sheets

BEADED CHAIN FOR BLINDS

BACKGROUND OF THE INVENTION

1. Field of Invention

The present invention relates generally to devices for rotating, opening and closing curtains or slats of blinds, and more specifically to a beaded chain and/or cord having a distinguishing characteristic on at least a portion of the length of the beaded chain or cord that aids a user in rotating blind slats and/or moving blinds or curtains in a desired direction.

2. Background

Vertical blinds typically use a continuous beaded chain to rotate a series of vertical slats through 180 degrees. By pulling on one side of the chain, the slats rotate in one direction, e.g. to the right, and by pulling on the other side of the chain, the slats rotate in the opposite direction, e.g. to the left. Similarly, cords are utilized in curtains and blinds for opening or closing the curtains or blinds in a horizontal or vertical direction. Existing beaded chains utilize a continuous beaded chain in which all of the beads are of uniform size. This introduces a purely "by chance" event when rotating the slats as there is no way for an operator to know which chain is going to produce the desired result. Similarly, a person desiring to open the curtains or blinds will pull on a side of a cord only to watch the curtains and blinds close. The resulting undesired movement of the blinds or curtain, more often than not, elicits exclamations of frustration along with an overzealous tug on the other side of the cord.

In addition to frustrating the operator, pulling the incorrect cord introduces unnecessary wear and tear on the mechanisms of the curtain or blinds. For example, if curtains or blinds are fully opened, a hard tug on the cord stresses the cord because the curtain or blind does not move in response to the downward pulling force. A strong tug on the cord when the curtain or blind is at full extension, either opened or closed, has the potential of snapping the cord, or worse, pulling an entire curtain assembly off of a wall. Similarly, a tug on the incorrect side of the beaded chain, will cause the beaded chain or the gearing to slip which, over an extended time, will degrade the rotational mechanisms of the blinds.

FIG. 1 illustrates the cord 4 and beaded chain 2 of the prior art that interact with the control assembly 8 of the curtain or blind slats 6. In a typical window blind, the beaded chain 2 loops around a sprocket (not shown) that is linked to each slat 6 to rotate the slat 6 through 180 degrees of rotation. By pulling on a first chain side 2*a*, the slats 6 rotate in a first direction, and by pulling on a second chain side 2*b* the slats 6 rotate in a second direction. For example, to angle the slats 6 to the left, an operator must tug on the first chain side 2*a*, and to angle the slats 6 to the right, the operator must tug on the second chain side 2*b*. A tug on the incorrect chain side results in an undesirable position of the slats 6 and/or stress on or slippage of the beaded chain.

The beaded chain 2 of the prior art of FIG. 1 does not provide an operator with the opportunity to learn which chain side 2*a*, 2*b* to pull because the beaded chain 2 tends to hang in such a manner that the sides 2*a*, 2*b* of the chain are indistinguishable, For example, the chain sides 2*a*, 2*b* often are touching or are wound around each other, and may not be in predictable locations, e.g. to the front or to the back, due to interference with the blinds, furniture, or the window sill. Further, the typical operator does not have the patience to scrutinize the chain 2 and sprocket (not shown) to determine which side 2*a*, 2*b* to pull.

Referring again to FIG. 1, the cord 4 of the prior art typically loops the entire length of the curtains or blinds 6 through the control assembly 8. A tug on a first cord side 4*a* causes the blinds to open, and a tug on the second cord side 4*b* causes the blinds to close. The cord 4 presents similar problems as presented by the beaded chain 2 in that an operator will inevitably pull the cord side 4*a*, 4*b* that results in an undesirable movement of the curtains or blinds. Thus, a need for a distinguishing beaded chain and cord exists that will assist an operator in determining which chain side 2*a*, 2*b* or which cord side 4*a*, 4*b* to pull to obtain a desired result.

SUMMARY OF THE INVENTION

It is an advantage of the present invention to provide a differentiated beaded chain and/or cord for opening or closing blinds or curtains.

It is a further advantage to provide a differentiated beaded chain and/or cord that enables a user to manipulate blinds or curtains in a desired manner.

It is another advantage to provide a differentiated beaded chain or cord that prevents wear and tear on the curtain/blind mechanisms by teaching a user to pull the correct side of the beaded chain and/or cord.

It is still another advantage of the present invention to eliminate random outcomes of attempts to open or close curtains, blinds, or slats.

A differentiated beaded chain of an exemplary embodiment of the present invention is constructed of at least two different bead sizes that are distinguishable by touch and/or by sight. In an exemplary embodiment, a first portion of the beaded chain utilizes a standard bead size #8 that has a diameter of approximately 0.156 inches (3.96 mm). The remaining portion of the chain utilizes a second bead size #13 that has a diameter of approximately 0.250 inches (6.35 mm). In other embodiments the bead sizes of the first portion and the remaining portion may vary as long as the bead sizes are compatible with a curtain or blind sprocket. The bead sizes #8 and #13 of the exemplary embodiment present advantages of compatibility with existing sprockets as well as chain strength. The differentiated beaded chain of the exemplary embodiment is installed on the beaded chain drive sprocket of the curtain and/or blind unit at the time of manufacture.

Beaded chains utilized for rotating a sprocket-type assembly have a first length for feeding into one side of the sprocket-type assembly and a second length for feeding out of a second side of the sprocket-type assembly. In a looped beaded chain the sprocket assembly defines one end of the loop, and the first and second length each define on half of the loop length. In an exemplary embodiment, the differentiated beaded chain is positioned such that a first bead size portion is located along the first length, and a second bead size portion is located along the second length when the blinds are at a predetermined initial position, e.g. at a 90 degree open position. Thus, to rotate the blinds to the right, or to a 180 degree closed position, the operator pulls on the first bead size portion. To rotate the blinds to the left, or back through the 90 degree position to the 0 degree closed position, the operator simply pulls on the second bead size portion.

The repeated manipulations of the blinds, teaches an operator that a tug on a large beaded chain length produces a certain rotation of the blinds, and a tug on a small beaded chain length produces an opposite rotation of the blinds. The operator can easily distinguish the beaded chain sizes by sight or feel, and thus, the operator will consistently achieve the desired rotation of the blind slats. The known result of a tug on a large or small beaded chain length will prevent wear and tear on the sprocket-type assembly that may result due to slippage of the beaded chain.

The beaded chain of the exemplary embodiment utilizes at least two bead lengths of metal-based beads that vary according to size to provide a sight and feel differentiation. In an alternative embodiment, the first and second bead length may utilize beads having varying texture, wherein one of the first and second bead lengths is coated or rubberized to provide a sight and feel differentiation. This latter embodiment may employ either a beaded chain of a single bead size, or a beaded chain of two bead sizes wherein the coating or rubberization provides an added means for differentiating a length of beads.

The exemplary embodiment of the present invention may be incorporated into existing beaded chains having a single size of bead throughout the entire chain loop. An exemplary method of retrofitting an existing beaded chain includes the step of replacing one of the first or second bead lengths with a beaded chain length having a bead size that is either smaller or larger than that of the existing beaded chain. The bead size of a typical existing beaded chain is size #8, or 0.156 inch diameter (3.96 mm). Thus, the step of replacing one of the first or second bead lengths includes splicing the existing beaded chain adjacent a first end and a second end, and inserting a #13 beaded chain length utilizing splicing links. In the exemplary embodiment, a standard #10 splicing link having a length of approximately 0.531 inches (13.49 mm) and a diameter of 0.25 inches (6.35 mm) readily accepts the #8 bead and the #13 bead. The splicing links of the exemplary embodiment are accepted into the sprocket assembly, and thus, the splicing links do not interfere with the rotation of the sprocket. In an alternate embodiment, a coated beaded chain is utilized as the replacement beaded chain length to provide differentiation of the chain lengths.

Certain sprocket assemblies may have close tolerances that only accept the bead size of the originally-installed beaded chain. Alternatively, it may be desirable to utilize the existing beaded chain, for example size #8, so as not to affect the existing operating mechanism of the slat rotation. An exemplary method for retrofitting close tolerance beaded chain assemblies includes the steps of fully rotating the slates by pulling on a first side of the chain, and splicing in the differentiated bead length along a second side of the chain as described above. Thus, since the chain has rotated through the sprocket assembly to a fully rotated position, the splice will not be pulled through the sprocket.

In another embodiment, the beads of the originally-installed beaded chain may be mid-sized and not well-suited for differentiation purposes. For example, the installed bead size may be size #10 having an approximate diameter of 0.178 inches (4.52 mm), such that a replacement beaded chain length having either size #8 or size #13 beads will not provide a sufficient size differentiation. A method for retrofitting a mid-sized beaded chain includes the steps of rotating the blind slats to an initial position of 90 degrees, splicing a first smaller beaded chain along a first length utilizing a first splicing link, splicing a second larger beaded chain along a second length utilizing a second splicing link, and connecting the first smaller beaded chain to the second larger beaded chain utilizing a third splicing link. For sprocket assemblies having close tolerances, the above method further includes the step of maintaining a sufficient length of originally-installed beaded chain length wrapped around, and adjacent, the sprocket such that the originally-installed beaded chain rotates the slats to a fully closed position to either the left or to the right.

The exemplary embodiment of the present invention may also utilize a differentiated cord to aid in opening or closing curtains or blind slats along a vertical or horizontal plane. The differentiated cord has a first length and a second length that extends below a valence level (or the opening/closing mechanism), and that may be defined when the curtains or blinds are fully opened or closed. A cord length of a different texture may be spliced along one of the first or second lengths during or after manufacture. For example, a cord having a smooth texture for the bulk of length and a "hairy" texture for the spliced-in length will provide sufficient differentiation for an operator. In an exemplary embodiment, if the hairy length of the cord comprises the first length when the curtains or blinds are fully closed, then the operator knows that tugging on the smooth length of the cord will open the blinds/curtains, and tugging on the hairy length of the cord will re-close the blinds/curtains.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

Figure 1:
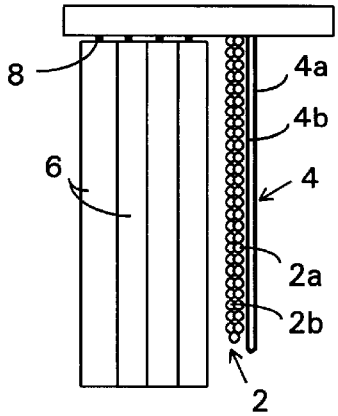
FIG. 1 PRIOR ART
FIG. 1 is an illustration of the prior art beaded chain and cord.
Figure 2A:
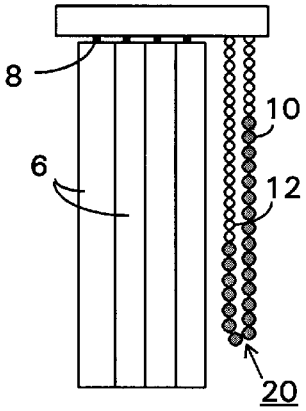
FIG. 2*a* is an illustration of a differentiated beaded chain of a preferred embodiment when the blind slats are fully rotated in a first direction.
Figure 2B:
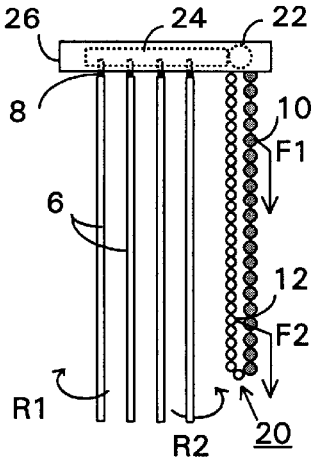
FIG. 2*b* is an illustration of the differentiated beaded chain in an initial position of rotation.
Figure 2C:
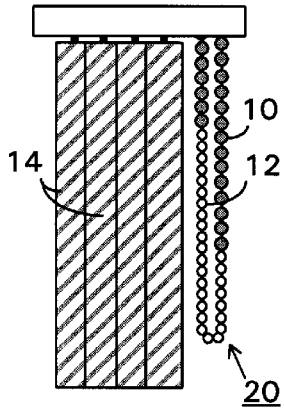
FIG. 2*c* is an illustration of the differentiated beaded chain when the blind slats are fully rotated in a second direction.

FIGS. 2*a*, 2*b*, and 2*c* illustrate the differentiated beaded chain of vertical blinds of a preferred embodiment of the present invention. As shown in FIG. 2*b*, the vertical blind assembly includes slats 6 that are rotatable in a first direction R1 and a second direction R2. The slats 6 are rotated by applying a force F1 on a first chain side 10 of a beaded chain 20 or a force F2 on a second chain side 12 of a beaded chain 20. The beaded chain 20 rotates a sprocket-type assembly 22 which, in turn, rotates the slats 6 by means of a linkage assembly 24. As shown in FIG. 2*b*, the beaded chain of a preferred embodiment comprises a first chain side 10 of larger-sized beads and a second chain side 12 of smaller-sized beads. The beaded chain is positioned to have all large beads on the first chain side 10, and all small beads on the second chain side 12 when the slats 6 are positioned in an initial position. The initial slat position of a preferred embodiment is an open position of 90 degrees. A position of 0 degrees, as shown in FIG. 2*a*, closes the slats 6 with a first side of the slats facing the operator, and similarly, a 180 degree position, as shown in FIG. 2*c*, closes the slats with a second side of the slats 14 facing the operator. In alternate embodiments, the initial position may be chosen as desired, for example, a closed position of either 0 degrees or 180 degrees.

In a preferred embodiment, as shown in FIG. 2*b*, a downward force F1 on the first chain side 10 rotates the blinds in a first direction R1, and a downward force F2 on the second chain side 12 rotates the blinds in a second direction R2. FIGS. 2*a*–2*b* are for illustrative purposes, only, and the direction of rotation R1, R2 in response to downward forces F1, F2 may be switch in other embodiments of the present invention. Further, the sprocket assembly 22 of alternate blind systems may be positioned so that the chain hangs with a first chain side 10 behind or in front of a second chain side 12.

The beaded chain 20 of the present invention provides a user a means for opening and closing the blind slats in a predictable rotation R1, R2. In a preferred embodiment as illustrated in FIG. 2*b*, a user learns, through repeated use, that a downward pull F1 on larger beads of a first chain side 10 produces a predictable result of the blinds rotating in a first rotational direction R1, for example, to the left. Referring to FIG. 2*a*, when a user wishes to rotate the blind slats open, he or she may utilize a number of sight and touch cues from the beaded chain 20. A visual cue presented by the beaded chain 20 of FIG. 2*a* is that the larger beads and smaller beads are not positioned evenly on one or the other side of the beaded chain 20. Thus, the beaded chain 20 prompts the user to pull on the second chain side 12 of smaller beads in order to even the beads and, thereby, open the slats 6. Alternatively, the user is simply prompted by the bead size, and learns, through repeated use, that rotation of the slats 6 in the R2 direction, for example, to the right, requires a downward force applied to the smaller beads of the second chain side 12.

The beaded chain 20 also provides touch cues. A user may grab both chain sides 10, 12, and, by the distinguishing feel of the beads, may quickly chose the larger beaded chain section 10 to rotate the blinds to the left, or alternately chose the smaller beaded chain section 12 to rotate the blinds to the right. The use of different size beads in the beaded chain 20 allows the user to predictably manipulate the blind slats 6 by feel during periods of low light levels, such as at night, dusk or dawn without having to turn on lights.

Figure 5:
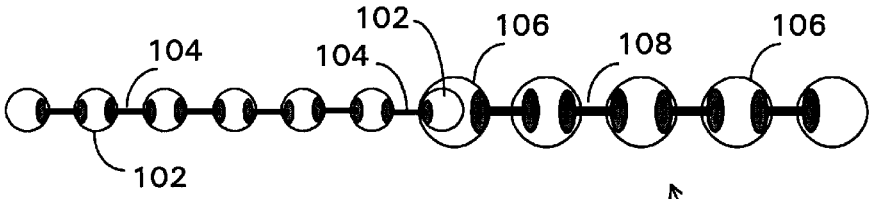
FIG. 5 is a cross section of a differentiated beaded chain that is installed at the time of manufacture of a blind.

The beaded chain of the preferred embodiment may be installed at the factory, or retro-fit to an existing blind assembly. FIG. 5 illustrates a beaded chain section 100 of a pre-installed beaded chain of a preferred embodiment of FIG. 2*b*. A series of smaller beads 102 are linked by small linking segments 104. Similarly, a series of larger beads 106 are linked by large linking segments 108. A smaller bead 102 may be utilized to directly linked the smaller bead section to the larger bead section by placing a smaller bead 102 within a larger bead 106. During installation, the beaded chain section 100 is positioned on the sprocket assembly in a desired initial position.

The preferred embodiment of a pre-installed beaded chain 100 utilizes a small bead 102 having a #8 bead size of approximately 0.156 inches (3.96 mm), and a large bead 106 having a #13 bead size of approximately 0.250 inches (6.35 mm). In another embodiment of a pre-installed beaded chain, a #8 small bead 108 segment is directly linked to a large bead 106 segment having a #10 bead size of approximately 0.178 inches (4.52 mm). Other embodiments may utilize other bead sizes wherein the large bead 106 and small bead 102 are sufficiently differentiable by either sight or touch.

Figure 4:
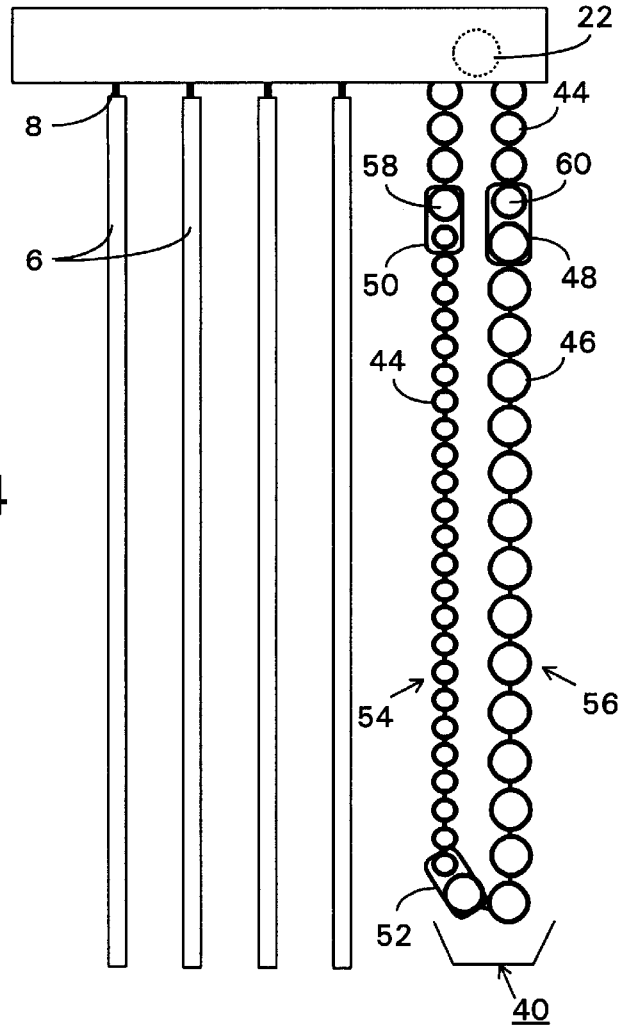
FIG. 4 is an illustration of a method of retrofitting a beaded chain.

FIG. 4 illustrates a retrofitted beaded chain 40 having an originally-installed beaded chain 44 utilizing size #10 beads. To provide a maximum differentiation of beaded chain sections, a #8 bead section 44 is spliced to the originally-installed beaded chain 44 utilizing a first splicing link 50 on a first chain side 54, and a #13 bead section 46 is spliced to the originally-installed beaded chain 44 utilizing a second splicing link 48 on a second chain side 56. The first chain side 54 is then spliced to the second chain side 56 utilizing a third splicing link 52. In a preferred embodiment, the splicing links 48, 50, 52 are a size #10 splicing link having a length of approximately 0.531 inches (13.49 mm) and a diameter of 0.25 inches (6.35 mm).

Figure 6:
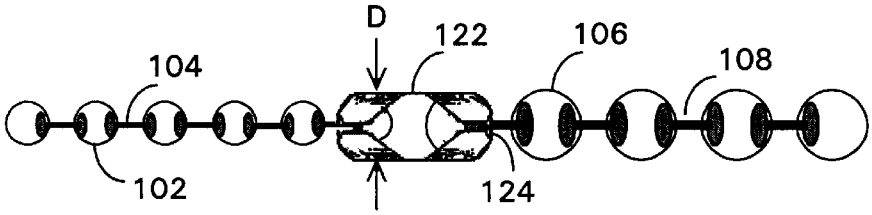
FIG. 6 is a cross section of a retrofitted beaded chain.

FIG. 6 illustrate retrofitted beaded chain 120 having a small bead 102 chain section connected to a large bead 106 chain section utilizing a splicing link 122. The splicing link 122 may be any size that will accept two different bead sizes. The choice of splicing link 122 is limited by the diameter D and the hole 124 that provides an exit for linking segments 104, 108. A hole 124 that is too large will permit a small bead 102 to slip out of the splicing link 122. The splicing link 122 size may also be limited by the configuration of a sprocket assembly 22. Referring again to FIG. 4, a sprocket assembly 22 having tolerances specific to a pre-installed bead size 44 may not readily accept either a splicing link 48, 50 or a larger bead size 46. In such circumstances, the retrofitted beaded chain 40 must maintain a sufficient length of the original beaded chain 44 to permit a full rotation of the blinds to the right or to the left.

A method of retrofitting a beaded chain 40 of a preferred embodiment, as shown in FIG. 4, includes the steps of rotating the blind slats 6 to a desired initial position of 90 degrees, removing a portion of the original bead section below a first end bead 58 and a second end bead 60, splicing a first beaded chain section 44 on a first chain side 54, splicing a second beaded chain section 46 on a second chain side 56, and connecting the first chain side 54 to a second chain side 56. In an alternate embodiment, wherein the original bead section 44 utilizes a sufficiently small or large bead size, it is necessary to replace only one of the first side 54 or second size 56 of the beaded chain 44 with a beaded chain section having a bead size that is easily differentiated from the bead size of the original bead section 44.

Referring to FIGS. 2*b*, an alternative embodiment of the beaded chain 20 of the present invention utilizes a first chain side 10 having beads that are texturally differentiated from the beads of a second chain side 12. The texture of the first and second chain sides 10, 12 are distinguishable by both look and feel. In an alternate embodiment of the present invention, one of the first and second chain sides 10, 12 utilizes a rubberized coating, colored or clear, on each bead to affect a change in texture. The embodiments of the present invention, as illustrated in FIGS. 2*b* and 4, also may be implemented for beaded chains manufactured from extruded plastic.

Figure 3A:
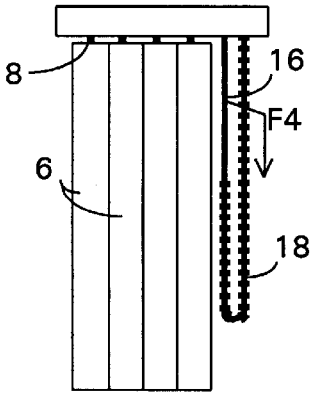
FIG. 3*a* is an illustration of a differentiated cord of a preferred embodiment when the blinds are closed along a horizontal plane.
Figure 3B:
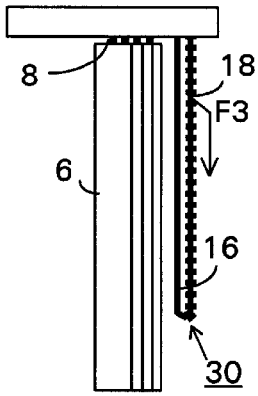
FIG. 3*b* shows the positioning of the differentiated cord when the blinds are in an initial opened position along a horizontal plane.

FIGS. 3*a* and 3*b* illustrate the present invention as applied to cords for opening and closing curtains or blinds. FIG. 3*b* shows blinds 6 in an initial open position. A differentiated cord 30 has a first cord segment 18 that is texturally different from a second cord segment 16. An operator must apply a downward force F3 on the first cord segment 18 to close the blinds in a horizontal direction, as shown in FIG. 3*a*. To open the blinds 6, a downward force F4 is applied to the second cord segment 16. Textural differences may be realized in a number of ways including the use of a smooth segment and a fuzzy segment of cord, the use of a smooth segment and a rubberized segment of cord, the use of a smooth segment and a knotted segment, and the use of any other combination thereof.

The differentiated cord or beaded chain teaches an operator, through repeated use and observation of resulting movement of the curtain and blinds, to predictably open blinds or curtains and rotate blind slats. A predictable result provides a means to avoid operator frustration and wear and tear on the opening mechanics 8 of the blinds and/or curtains.

Although a preferred embodiment of the invention has been described above by way of example only, it will be understood by those skilled in the field that modifications may be made to the disclosed embodiment without departing from the scope of the invention, which is defined by the appended claims. For example, the invention also is applicable for other devices utilizing cords, beaded chains and sprocket-type devices rotated by a beaded chain.

We claim:

1. An assembly for rotating slats of blinds, comprising:

a sprocket assembly having linkages to a plurality of blinds for rotating the plurality of blinds in a first direction when the sprocket assembly rotates in a first direction and in a second direction when the sprocket assembly rotates in a second direction;

a beaded chain operable with the sprocket assembly for rotating the sprocket assembly in one of the first direction and the second direction, the beaded chain comprising;

a first chain section comprising a plurality of first section beads for rotating the sprocket assembly in the first direction when a force is applied to the first chain section; and a second chain section comprising a plurality of second section beads having a distinguishing characteristic from the plurality of first section beads, the second chain section for rotating the sprocket assembly in the second direction when the force is applied to the second chain section.

2. The assembly for rotating slats of blinds of claim 1, wherein the beaded chain is a continuous loop.

3. The assembly for rotating slats of blinds of claim 1, wherein the first chain section comprises half of the chain length.

4. The assembly for rotating slats of blinds of claim 1, wherein the first chain section and the second chain section comprise a plurality of metal beads.

5. The assembly for rotating slats of blinds of claim 1, wherein the beaded chain comprises a plurality of plastic beads.

6. The assembly for rotating slats of blinds of claim 1, wherein the distinguishing characteristic is bead size.

7. The assembly for rotating slats of blinds of claim 6, wherein the first chain section comprises a plurality of metal beads having a standard diameter of size #8.

8. The assembly for rotating slats of blinds of claim 7, wherein the standard diameter of size #8 is 0.156 inches (3.96 mm).

9. The assembly for rotating slats of blinds of claim 6, wherein the second chain section comprises a plurality of beads having a standard diameter of size #13.

10. The assembly for rotating slats of blinds claim 9, wherein the standard diameter of size #13 is 0.250 inches (6.35 mm).

11. The assembly for rotating slats of blinds of claim 1, wherein the distinguishing characteristic is textural.

12. The assembly for rotating slats of blinds of claim 11, wherein one of the first chain section and the second chain section comprises coated beads.

13. A method of retrofitting an assembly for rotating slats of blinds, the assembly having a sprocket assembly rotated in a first direction by a first portion of beaded chain and rotated in a second direction by a second portion of beaded chain, the first and second portions of beaded chain having a plurality of same size original beads, the method comprising the step of:

replacing the first portion of the beaded chain with a first replacement length having a plurality of first-sized beads that are distinguishable from the plurality of original beads such that a pulling force on the first replacement length rotates the sprocket assembly in the first direction.

14. The method of retrofitting an assembly for rotating slats of blinds as in claim 13, further comprising the step of:

replacing a second portion of the beaded chain with a second replacement length having a plurality of second-sized beads that are distinguishable from the original and first-sized beads.

15. The method of retrofitting an assembly for rotating slats of blinds as in claim 13, wherein the step of replacing a first portion of the beaded chain further comprises:

linking a first end of the first replacement length to the beaded chain utilizing a first splicing link; and linking a second end of the first replacement length to the beaded chain utilizing a second splicing link.

16. A method of teaching an operator to manipulate an apparatus in a predictable manner; the method comprising the step of:

providing a differentiated beaded chain having a first length of beads differentiated from a second length of beads, wherein the first and second length of beads are differentiated to provide a cue to the operator, and wherein pulling the first length of beads results in a first manipulation of the apparatus, and pulling the second length of beads results in a second manipulation of the apparatus.

17. The method of teaching an operator to manipulate an apparatus as in claim 16, where the beaded chain is a differentiated cord having a first length of cord that is texturally differentiated from a second length of cord.

18. The method of teaching an operator to manipulate an apparatus as in claim 16, wherein the cue is one of a visual cue or a touch cue.

19. A cord assembly for opening blinds or curtains, comprising:

a open/close mechanism connected to the blinds or the curtains for opening and closing the blinds or the curtains along one of a horizontal and a vertical plane;

a first cord section connected to the open/close mechanism for opening the blinds or the curtains, the first cord section comprising a length of first texture cord; and a second cord section connected to the open/close mechanism for closing the blinds or the curtains, the second cord section comprising a length of second texture cord;

wherein the length of first texture cord and the length of second texture cord are distinguishable by sight and feel.

20. The cord assembly as in claim 19, wherein one of the first cord section and the second cord section are coated with a rubber material.

21. The cord assembly as in claim 19, wherein the first cord section comprises a smooth cord length, and the second cord section comprises a non-smooth cord length.

* * * * *